US008371268B2

(12) United States Patent
Masellis et al.

(10) Patent No.: US 8,371,268 B2
(45) Date of Patent: Feb. 12, 2013

(54) SAFETY VALVE AND HIGH-PRESSURE PUMP COMPRISING SAID SAFETY VALVE

(75) Inventors: Mariacarmela Masellis, Bari (IT); Benedetto Loiacono, Modugno (IT); Thomas Riedel, Hattenhofen (DE); Werner Striegel, Oberriexingen (DE); Nello Medoro, Trinitapoli (IT)

(73) Assignee: Robert Bosch GmbH, Stuttgart (DE)

( * ) Notice: Subject to any disclaimer, the term of this patent is extended or adjusted under 35 U.S.C. 154(b) by 449 days.

(21) Appl. No.: 12/744,434

(22) PCT Filed: Nov. 13, 2008

(86) PCT No.: PCT/EP2008/065449

§ 371 (c)(1),
(2), (4) Date: May 24, 2010

(87) PCT Pub. No.: WO2009/065761

PCT Pub. Date: May 28, 2009

(65) Prior Publication Data

US 2010/0242915 A1 Sep. 30, 2010

(30) Foreign Application Priority Data

Nov. 23, 2007 (IT) ..... MI2007A2219

(51) Int. Cl.
*F02M 37/00* (2006.01)

(52) U.S. Cl. ..... 123/446; 123/510; 417/470

(58) Field of Classification Search ..... 123/446, 123/457, 479, 510, 511, 198 D; 417/470, 417/494, 441, 454

See application file for complete search history.

(56) References Cited

U.S. PATENT DOCUMENTS

| | | | | |
|---|---|---|---|---|
| 6,209,523 | B1 | 4/2001 | Lehtonen | |
| 6,450,788 | B1 * | 9/2002 | Grabert | 417/570 |
| 6,725,844 | B2 * | 4/2004 | Banzhat et al. | 123/495 |
| 2003/0079726 | A1 | 5/2003 | Banzhaf et al. | |
| 2004/0155120 | A1 | 8/2004 | Boos et al. | |
| 2010/0258092 | A1 * | 10/2010 | Ammon | 123/506 |

FOREIGN PATENT DOCUMENTS

| | | | |
|---|---|---|---|
| EP | 0964153 | A2 | 12/1999 |
| EP | 1403509 | A2 | 3/2004 |
| WO | 03067075 | A1 | 8/2003 |

* cited by examiner

*Primary Examiner* — Hai Huynh

(74) *Attorney, Agent, or Firm* — Michael Best & Friedrich LLP

(57) ABSTRACT

A fuel safety valve arranged in a fuel supply line between a low-pressure pump and a high-pressure pump, is provided with a valve body which defines a cylindrical cavity having a longitudinal axis and being connected to a duct and a portion of a discharge duct in communication with the cylindrical cavity, a piston sliding with respect to the valve body in the cylindrical cavity along the longitudinal axis, and a spring housed in a variable-volume chamber defined by a portion of the cylindrical cavity between the piston and a closure element. The piston is provided with a through hole supplied with the fuel leading into the variable-volume chamber, and the valve body being provided with a fuel discharge hole connecting the variable-volume chamber to the discharge duct.

20 Claims, 2 Drawing Sheets

SAFETY VALVE AND HIGH-PRESSURE PUMP COMPRISING SAID SAFETY VALVE

CROSS-REFERENCE TO RELATED APPLICATION

This application is a 35 USC 371 application of PCT/EP2008/065449 filed on Nov. 13, 2008.

BACKGROUND OF THE INVENTION

1. Field of the Invention

This invention relates to a safety valve. It particularly relates to a safety valve and a high-pressure pump for an internal-combustion engine comprising said safety valve.

2. Description of the Prior Art

Internal-combustion engines usually comprise a low-pressure pump, a high-pressure pump, a manifold, a low-pressure supply line connecting the low-pressure pump to the high-pressure pump, and a high-pressure delivery line connecting the high-pressure pump to the manifold or "common rail" as it is generally called.

The low-pressure line generally comprises a metering solenoid valve capable of controlling the amount of fuel supplied to the high-pressure pump, and a safety valve whose job is to discharge excess fuel supplied by the low-pressure pump in order to prevent damage to the low-pressure line caused by high pressures.

OBJECT AND SUMMARY OF THE INVENTION

Safety valves that are generally used for this purpose comprise a valve body, which defines a cylindrical cavity having a longitudinal axis and a portion of a discharge duct communicating with the cylindrical cavity, a piston which slides with respect to the valve body inside the cylindrical cavity along the longitudinal axis, and a spring housed in a variable-volume chamber defined by a portion of the cylindrical cavity between the piston and a closure element. In use, excess fuel pushes the piston into the cylindrical cavity, overcoming the opposing force of the spring, until the discharge duct is no longer obstructed by the piston and the fuel is able to pass into the discharge duct.

However, this type of valve suffers from a primary drawback.

During use, these valves can be very noisy. This is mainly due to cavitation phenomena, in which air bubbles form inside the variable-volume chamber, generating vibrations that are then transmitted to the ducts to which the valve is connected. These vibrations cause resonance if the low-pressure ducts to which the valve is connected are made of metal.

It is an object of the present invention to provide a safety valve that does not have the drawbacks indicated above of the prior art. In particular, it is an object of the invention to provide a valve that is quiet and at the same time easy and inexpensive to produce.

In accordance with these objects, the present invention relates to a fuel safety valve arranged in a fuel supply line between a low-pressure pump and a high-pressure pump. The valve has a valve body which defines a cylindrical cavity having a longitudinal axis and being connected to a duct of a fuel supply line, and a portion of a discharge duct in communication with the cylindrical cavity. A piston sliding with respect to the valve body is disposed in the cylindrical cavity along the longitudinal axis. A spring housed in a variable-volume chamber is defined by a portion of the cylindrical cavity between the piston and a closure element. The piston is provided with a through hole supplied with the fuel leading into the variable-volume chamber, and in that the valve body is provided with a fuel discharge hole connecting the variable-volume chamber to the discharge duct.

It is a further object of the present invention to provide a quiet and reliable high-pressure pump. In accordance with these objects the present invention relates to a high-pressure pump having a pump body, a portion of a low-pressure fuel supply line, at least one pumping element, and a portion of a high-pressure delivery line. The high-pressure pump has a fuel safety valve arranged in the portion of the supply line.

BRIEF DESCRIPTION OF THE DRAWINGS

Other features and advantages of the present invention will be clearly seen in the following description of a non-restrictive illustrative embodiment thereof, with reference to the figures of the appended drawings, in which.

DESCRIPTION OF THE PREFERRED EMBODIMENT

Figure 1:
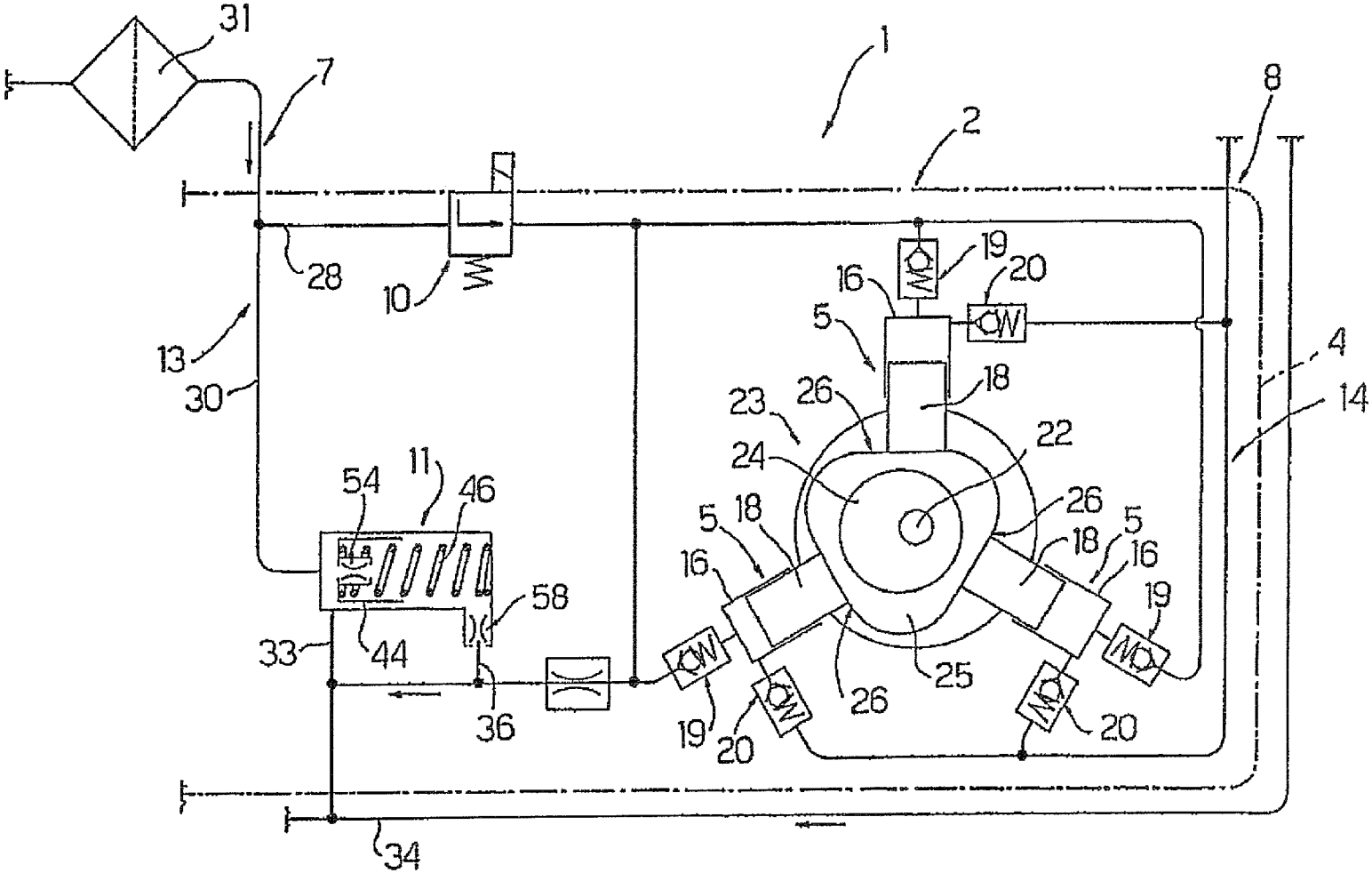
FIG. 1 is a diagram of a fuel supply line to an internal-combustion engine, showing the safety valve and the high-pressure pump of the present invention.

In FIG. 1, reference number 1 is a fuel supply line to an internal-combustion engine. The line 1 comprises a high-pressure pump 2, which comprises a pump body 4 and three pumping elements 5, a low-pressure supply line 7 connecting a low-pressure pump (not shown for simplicity in the appended figures) to the high-pressure pump 2, a high-pressure delivery line 8 running from the high-pressure pump 2 to a common rail (not shown in the appended figures), a metering solenoid valve 10 and a safety valve 11.

In particular, the pump body 4, indicated in FIG. 1 by a chain line, comprises a portion 13 of the low-pressure supply line 7 and a portion 14 of the high-pressure delivery line 8. The metering solenoid valve 10 and the safety valve 11 are preferably mounted directly on the pump body 4.

Each pumping element 5 is defined by a cylinder 16 in which a piston 18 reciprocates. Each cylinder 16 is in communication with the supply line 7 via a supply valve 19, and is in communication with the delivery line 8 via a delivery valve 20.

The three pumping elements 5 are arranged radially at angles of 120° about a shaft 22 which is part of the drive mechanism 23 of the three pistons 18. The drive mechanism 23 essentially comprises an eccentric 24 which drives the three pistons 18 and is fixed to the shaft 22 which rotates in a known manner in bearings mounted on the pump body 4. The eccentric 24 is designed to drive a prism-like ring 25 which has three plane faces 26, on each of which a piston 18 of a respective pumping element 5 bears.

The supply line 7 is defined by a duct 28 placing the low-pressure pump (not shown in the attached figures) in communication with the high-pressure pump 2 via the metering solenoid valve 10, and by a duct 30 supplying the safety valve 11 with the excess fuel not necessary for supplying the high-pressure pump 2.

At a point on the duct 28, downstream of the low-pressure pump and upstream of the metering solenoid valve 10, there is preferably a filter 31 for separating out dirt and/or water from the fuel aspirated by the low-pressure pump.

The metering solenoid valve 10 is capable of controlling the amount of fuel supplied to the high-pressure pump 2. The metering solenoid valve 10 is preferably controlled by an electronic unit, not shown in the appended figures, on the basis of the operating conditions of the engine.

The safety valve 11 is supplied by the duct 30 and is able to discharge excess fuel into a discharge duct 33, which leads to a discharge manifold 34 from where excess fuel from the common rail (not shown in the appended figures) is discharged into a fuel tank (not shown in the appended figures).

As will be seen in detail, the safety valve 11 is also connected to an outlet duct 36 which discharges fuel into the discharge duct 33.

Figure 2:
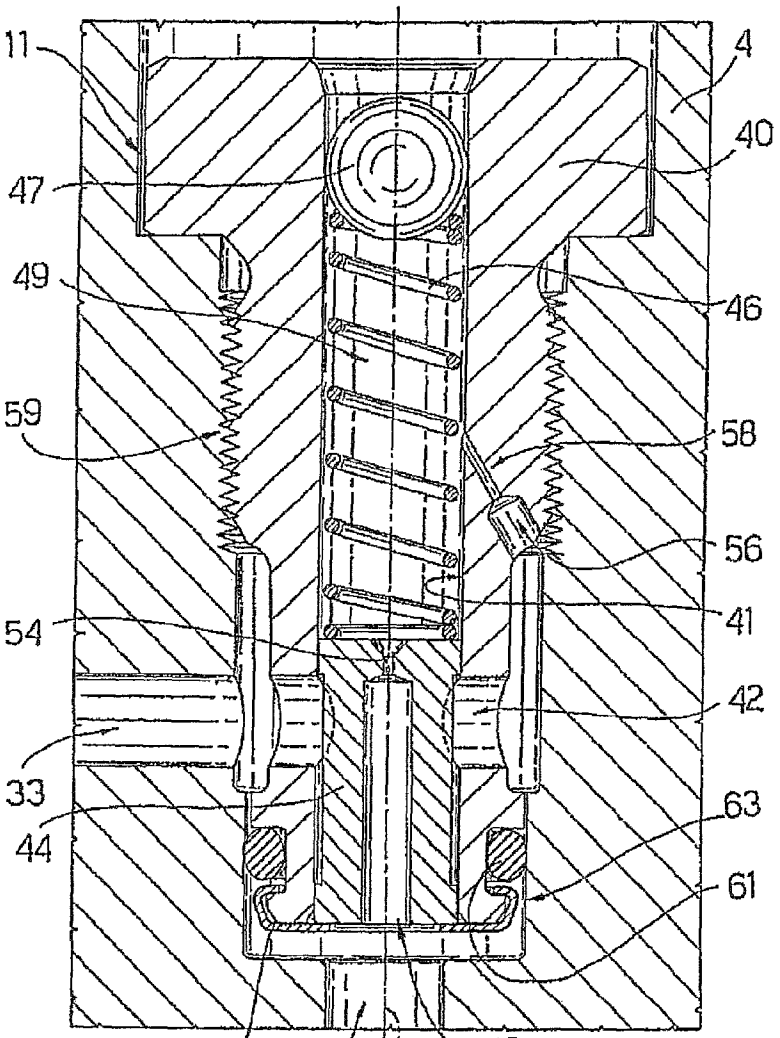
FIG. 2 is a sectional view, with parts removed for clarity, of the safety valve in a first operating position.

Referring to FIG. 2, the safety valve 11 comprises a valve body 40 which extends principally along a longitudinal axis A and defines a cylindrical cavity 41 and a portion 42 of the discharge duct 33. The cylindrical cavity 41 extends along the longitudinal axis A and is directly connected to the duct 30 of the low-pressure supply line 7, while the portion 42 of the discharge duct 33 is basically perpendicular to the longitudinal axis A and is in communication with the cylindrical cavity 41.

The safety valve 11 further includes a piston 44, which slides relative to the valve body 40 inside the cylindrical cavity 41; a spring 46; and a closure element 47.

The spring 46 is housed in a variable-volume chamber 49 defined by a portion of the cylindrical cavity 41 between the piston 44 and the closure element 47. In particular, the closure element 47 is a wall driven with an interference fit into the cylindrical cavity 41 in a position determined during assembly and defines an abutment for the spring 46.

Figure 3:
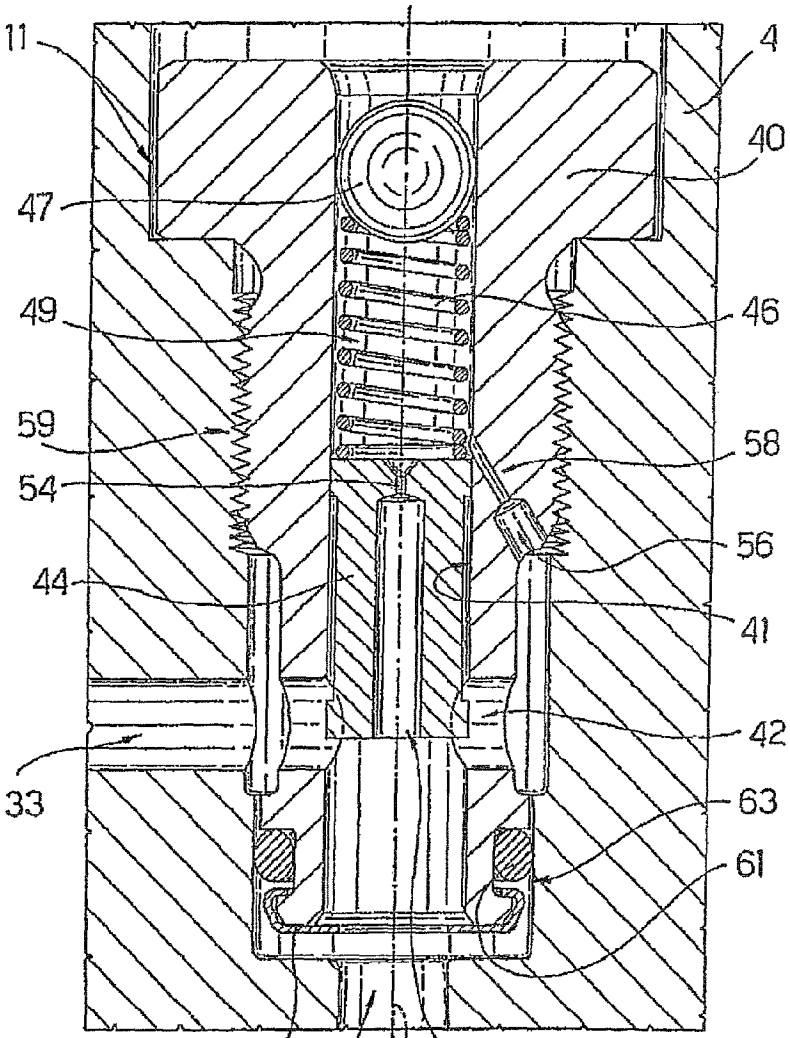
FIG. 3 is a sectional view, with parts removed for clarity, of the safety valve in a second operating position.

The piston 44 contains a through hole 52 passing all the way through the piston 44 essentially along the axis A so that the variable-volume chamber 49 is basically in communication with the duct 30 (FIG. 2) or with the inside of the cylindrical cavity 41 (FIG. 3).

The through hole 52 comprises, towards the end where it opens into the variable-volume chamber 49, an accurately sized restriction 54 to ensure the passage of a reduced flow rate of fuel.

The valve body 40 has a through discharge hole 56 connecting the variable-volume chamber 49 to the outlet duct 36. In particular, the discharge hole 56 is basically oblique with respect to the longitudinal axis A and has a restriction 58 which is accurately sized to ensure the passage of a reduced flow rate of fuel.

The accurately sized restriction 54 and the accurately sized restriction 58 both have the same cross-sectional area.

The valve body 40 has, in an approximately central position, an externally threaded portion 59 to allow the valve body 40 to be screwed directly onto the pump body 4 of the high-pressure pump 2. The valve body 40 also has a cover 60 containing a hole and a seal 61.

The cover 60 containing the hole is positioned between the cylindrical cavity 41 and the duct 30 of the low-pressure supply line 7; acts as a limit stop for the piston 44; and isolates the flow of fuel upstream of the safety valve 11 from the flow downstream of the safely valve 11.

The seal 61 is positioned in a recess 63 in the valve body 40 towards one end of the valve body 40 in contact with the duct 30.

In use, when the pressure of the fuel in the duct 30 rises above a predetermined value, the fuel in the duct 30 pushes the piston 44 along the cylindrical cavity 41, overcoming the opposing force of the spring 46, until the piston 44 is no longer obstructing the discharge duct 33 and fuel is able to flow into the discharge duct 33 (see FIG. 3). Some of the fuel enters the variable-volume chamber 49 through the through hole 52 of the cylindrical cavity 41 and exits through the discharge hole 56, partly owing to the reduction of the volume available in the variable-volume chamber 49.

The restriction 54 of the through hole 52 and the restriction 58 of the discharge hole 56 are accurately sized in order to determine a fuel pressure inside the variable-volume chamber 49 such as to limit cavitation phenomena and so prevent resonance phenomena occurring.

Clearly, modifications and variations may be made to the safety valve and high-pressure pump described herein without departing from the scope of the appended claims.

The invention claimed is:

1. A fuel safety valve arranged in a fuel supply line between a low-pressure pump and a high-pressure pump, the valve comprising:

a valve body which defines a cylindrical cavity which has a longitudinal axis and is connected to a duct of a fuel supply line and a portion of a discharge duct in communication with the cylindrical cavity;

a piston sliding with respect to the valve body in the cylindrical cavity along the longitudinal axis; and a spring housed in a variable-volume chamber defined by a portion of the cylindrical cavity between the piston and a closure element, wherein the piston is provided with a through hole supplied with the fuel leading into the variable-volume chamber, and the valve body is provided with a fuel discharge hole connecting the variable-volume chamber to the discharge duct.

2. The valve according to claim 1, wherein the through hole is provided with a through hole restriction which is accurately sized for a reduced flow rate of fuel.

3. The valve according to claim 2, wherein the through hole passes longitudinally through the piston in a direction approximately parallel to the longitudinal axis.

4. The valve according to claim 3, wherein the discharge hole is provided with a discharge hole restriction which is accurately sized for a reduced flow rate of fuel.

5. The valve according to claim 4, wherein the discharge hole extends inside the valve body in a direction approximately perpendicular to the longitudinal axis.

6. The valve according to claim 4, wherein the through hole restriction and the discharge hole restriction both have the same cross-sectional area.

7. The valve according to claim 2, wherein the discharge hole is provided with a discharge hole restriction which is accurately sized for a reduced flow rate of fuel.

8. The valve according to claim 7, wherein the through hole restriction and the discharge hole restriction both have the same cross-sectional area.

9. The valve according to claim 1, wherein the through hole passes longitudinally through the piston in a direction approximately parallel to the longitudinal axis.

10. The valve according to claim 9, wherein the discharge hole is provided with a discharge hole restriction which is accurately sized for a reduced flow rate of fuel.

11. The valve according to claim 10, wherein the through hole restriction and the discharge hole restriction both have the same cross-sectional area.

12. The valve according to claim 1, wherein the discharge hole is provided with a discharge hole restriction which is accurately sized for a reduced flow rate of fuel.

13. The valve according to claim 12, wherein the through hole restriction and the discharge hole restriction both have the same cross-sectional area.

14. The valve according to claim 1, wherein the discharge hole extends inside the valve body in a direction approximately perpendicular to the longitudinal axis.

15. The valve according to claim 1, wherein the discharge hole is connected to an outlet duct capable of discharging the fluid into the discharge duct.

16. The valve according to claim 1, wherein the valve body comprises an externally threaded portion.

17. The valve according to claim 1, wherein the closure element is a ball driven with an interference fit into the variable-volume chamber.

18. The valve according to claim 1, wherein the portion of the discharge duct is approximately perpendicular to the longitudinal axis.

19. A high-pressure pump comprising a pump body, at least one pumping element, a portion of a low-pressure fuel supply line, and a portion of a high-pressure delivery line, and a fuel safety valve as defined by claim 1, wherein the fuel safety valve is arranged in the portion of the supply line.

20. The pump according to claim 19, wherein the fuel safety valve is screwed onto the pump body.

* * * * *